US005500664A

United States Patent [19]

Suzuki et al.

[11] Patent Number: 5,500,664

[45] Date of Patent: Mar. 19, 1996

[54] INK JET RECORDING APPARATUS AND DETACHABLY MOUNTABLE INK JET CARTRIDGE

[75] Inventors: Etsurou Suzuki, Yokohama; Yoshifumi Hattori, Yamato; Masashi Kitani, Yokohama; Hideo Saikawa, Kawasaki; Masami Kojima; Kenji Kawano, both of Tokyo; Koichi Tanno; Kenji Aono, both of Kawasaki, all of Japan

[73] Assignee: Canon Kabushiki Kaisha, Tokyo, Japan

[21] Appl. No.: 339,882

[22] Filed: Nov. 14, 1994

Related U.S. Application Data

[63] Continuation of Ser. No. 825,588, Jan. 24, 1992, abandoned.

[30] Foreign Application Priority Data

| | | | |
|---|---|---|---|
| Jan. 25, 1991 | [JP] | Japan | 3-007759 |
| Jan. 25, 1991 | [JP] | Japan | 3-007760 |
| Jan. 25, 1991 | [JP] | Japan | 3-007761 |
| Jan. 25, 1991 | [JP] | Japan | 3-007769 |
| Jan. 25, 1991 | [JP] | Japan | 3-007770 |

[51] Int. Cl.[6] ..... B41J 2/175

[52] U.S. Cl. ..... 347/86

[58] Field of Search ..... 347/85–87, 7

[56] References Cited

U.S. PATENT DOCUMENTS

| | | | |
|---|---|---|---|
| 4,183,031 | 1/1980 | Kyser et al. | 346/140 R |
| 4,313,124 | 1/1982 | Hara | 346/140 R |
| 4,345,262 | 8/1982 | Shirato et al. | 346/140 R |
| 4,429,320 | 1/1984 | Hattori et al. | 346/140 R |
| 4,458,333 | 12/1985 | Sugitani et al. | 346/140 R |
| 4,459,600 | 7/1984 | Sato et al. | 346/140 R |
| 4,463,359 | 7/1984 | Ayata et al. | 346/1.1 |
| 4,500,895 | 2/1985 | Buck et al. | 346/140 R |
| 4,509,062 | 4/1985 | Low et al. | 346/140 R |

(List continued on next page.)

FOREIGN PATENT DOCUMENTS

| | | | |
|---|---|---|---|
| 0378240 | 7/1990 | European Pat. Off. . | |
| 0412459 | 2/1991 | European Pat. Off. . | |
| 3504216 | 8/1985 | Germany . | |
| 3938173 | 6/1990 | Germany . | |
| 54-56847 | 5/1979 | Japan . | |
| 0148168 | 11/1980 | Japan | 346/140 R |
| 55-161667 | 12/1980 | Japan . | |
| 0089161 | 5/1984 | Japan | 346/140 R |
| 59-98857 | 6/1984 | Japan . | |
| 59-123670 | 7/1984 | Japan . | |
| 59-138461 | 8/1984 | Japan . | |
| 59-207263 | 11/1984 | Japan . | |
| 60-71260 | 4/1985 | Japan . | |
| 63-87242 | 4/1988 | Japan . | |
| 0084963 | 4/1988 | Japan | 400/692 |
| 1-176566 | 7/1989 | Japan | 347/7 |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet cartridge has a recording head portion and an ink containing portion which are detachably mountable relative to each other. The recording head portion ejects ink to effect recording with the ink. The cartridge includes a first ink container, provided in the recording head portion, for containing the ink; a second ink container, provided in the ink containing portion, for containing the ink; and an ink communication tube for establishing ink communication between the first ink container and the second ink container, wherein the ink communication tube is not externally exposed. An ink jet recording apparatus includes a recording head for ejecting ink, an ink container detachably mountable to the recording head for containing the ink to be supplied to the recording head, a detecting device for detecting mounting of the ink container to the ink jet recording apparatus and a control device for controlling a recording operation of the ink jet recording apparatus in accordance with an output of the detecting device.

8 Claims, 12 Drawing Sheets

U.S. PATENT DOCUMENTS

| | | | |
|---|---|---|---|
| 4,610,202 | 9/1986 | Ebinuma et al. | 501/364 |
| 4,636,814 | 1/1987 | Terasawa | 346/140 R |
| 4,680,696 | 7/1987 | Ebinuma et al. | 346/75 |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,775,871 | 10/1988 | Abe et al. | 346/140 R |
| 4,928,126 | 5/1990 | Asai | 346/140 R |
| 4,970,533 | 11/1990 | Saito et al. | 346/140 R |
| 5,008,688 | 4/1991 | Ebinuma et al. | 346/140 R |
| 5,126,767 | 6/1992 | Asai | 346/140 R |

INK JET RECORDING APPARATUS AND DETACHABLY MOUNTABLE INK JET CARTRIDGE

This application is a continuation of application Ser. No. 07/825,588 filed Jan. 24, 1992, now abandoned.

FIELD OF THE INVENTION AND RELATED ART

The present invention relates to a liquid container, an ink cartridge integrally having a recording head for ejecting ink for recording operation and an ink container, said ink cartridge being detachably mountable on a recording apparatus, and an ink jet recording apparatus usable with the ink cartridge.

An ink jet cartridge comprising a recording head provided with means for generating energy contributable to ejection of ink droplets and an ink container for containing the ink to be supplied to the recording head wherein the ink jet cartridge is detachably mountable to a recording apparatus, is known.

FIGS. 11 and 12 shows an example of such an ink jet cartridge. The ink jet cartridge shown in FIG. 11 (see also) in Japanese Laid-Open Patent Application No. 87242/1988 (U.S. Pat. No. 4,771,295) comprises an integral recording head 300 and ink container 1100. The recording head comprises a heater board 301 on which electrothermal transducer elements are formed, a top plate 302 for constituting ink passages corresponding to the electrothermal transducers, an M-shaped spring 303 for clamping the heater board 301 and the top plate 302, a connecting member 304 for constituting an ink supply passage for supplying the ink from the ink container, an electrode board 305 for applying recording signals to the electrothermal transducer elements, and an aluminum plate 306 for supporting the above elements. The ink container 1100 contains therein a compressed absorbing material 900 in the form of porous material impregnated with the ink. The ink cartridge shown in FIG. 12 and disclosed in Japanese Laid-Open Patent Application No. 8857/1984 (U.S. Pat. No. 4,509,062) and Japanese Laid-Open Patent Application No. 207263/1984 (U.S. Pat. No. 4,500,895), is provided with an ink bladder 1000 of rubber material in the ink container 1100, with the ink bladder containing the ink.

Generally, such an ink jet cartridge involves a relatively large difference between the period in which the ink in the ink container is used up and the service life of the recording head. In other words, at the time when the ink is used up, and therefore, the recording head cartridge should be replaced with a fresh one, but the recording head of the old head cartridge is still usable. Even if the recording head can be manufactured at relatively low cost in the case of the cartridge type, it is still a relatively higher cost as compared with the manufacturing cost of the ink container attached to the recording head. One proposal has been made as to a recording head cartridge in which the ink container is detachably mountable to the recording head so as to permit replacement of the ink container and the recording head with fresh ones at different times, and therefore, to permit the effective use of the recording head.

In the ink jet recording apparatus using such an ink jet cartridge, the recording operation may be carried out without the ink container mounted or with an almost empty ink container. In the latter case, the ink container may become empty during the continuous recording operation. In addition, the ink may leak through the joint portion between the recording head and the ink container with the result of damage of the print board or the contamination of the apparatus. If the recording operation is carried out without the ink container mounted, and thereafter, the ink container is mounted, air may very likely be introduced through the joint portion between the recording head and the ink container, and into the ink passageway. This is not desirable because the air may be a cause of ink ejection failure. In order to remove such air, a number of suction processes (pumping or the like) is required as a part of ejection recovery. If the air in the form of bubbles is not removed, the liquid ejection may fail. In the separable type recording head and the ink container, the recording head is provided with an ink introduction cannula in the form of a needle and exposed to the outside. The cannula or needle tube is inserted into the ink outlet portion of the ink container, thus establishing communication therebetween.

However, the externally exposed needle of the recording head is not desirable from the standpoint of safety. Through the exposed tube, a content of the ink (water content) is evaporated with the result of introduction of the air into the recording head. This may adversely affect the ink ejection after the ink container is exchanged. The evaporation of the component results in increase of the viscosity of the ink. This may result in clogging of the ink supply pipe, and therefore, the improper communication between the ink container and the recording head. This again requires ejection recovery operation.

Therefore, such a printer is usually provided with a pumping mechanism in one form or another to suck and discharge the surrounding air and the ink in the passage between the ink ejection outlet and the ink supply inlet of the ink jet recording head.

This however involves the following problems:

(1) In order to discharge a small amount of air, it is necessary to suck a large amount of usable ink, and therefore, the running cost is high;

(2) The mechanism required for processing the removed residual ink and the pump mechanism require complicated and bulky structure of the main assembly of the printer with the result of increase of the cost; and (3) It involves a large number of limitations in position or structure so that the needle tube exposed in the apparatus is not exposed to the outside of the apparatus.

In the ink jet recording apparatus in which the introduction of the air is not desirable into the ink passage from the recording head to the ink container, the introduction of the air is significant. Where a cartridge type ink container is used in the ink jet recording apparatus, a pumping mechanism is inevitably required.

SUMMARY OF THE INVENTION

Accordingly, it is a principal object of the present invention to provide a communication establishing system between a recording head and an ink container, which is simple, small in size and low in cost, and in which the air is not introduced, and the ink in the connecting tube is not solidified.

It is another object of the present invention to provide a head cartridge and an ink jet recording apparatus in which the mounting or dismounting of the ink container to the main assembly of the recording apparatus is notified or is responded to by the control of the recording operation, so that the introduction of the air or the failure of the ink supply or the ink leakage attributable to the failure of the ink container, can be prevented beforehand.

According to an aspect of the present invention, there is provided an ink jet cartridge having a recording head portion and an ink containing portion which are detachably mountable relative to each other, wherein said recording head portion ejects ink to effect recording with the ink, comprising: a first ink container, provided in said recording head, for containing the ink; a second ink container, provided in said ink containing portion, for containing the ink; and ink communicating for establishing ink connection between said first ink container and said second ink container, wherein said ink communicating means is not externally exposed.

According to another aspect of the present invention, there is provided an ink jet recording apparatus, comprising: a recording head for ejecting ink; an ink container detachably mountable to said recording head and for containing the ink to be supplied to said recording head; detecting means for detecting mounting of said ink container to said ink jet recording apparatus; control means for controlling recording operation of said ink jet recording apparatus in accordance with an output of said detecting means.

According to a further aspect of the present invention, there is provided an ink jet recording apparatus, comprising: an ink jet cartridge having a recording head portion and an ink containing portion which are detachably mountable relative to each other, wherein said recording head portion ejects ink to effect recording with the ink, said cartridge including a first ink container, provided in said recording head, for containing the ink; a second ink container, provided in said ink containing portion, for containing the ink; and ink connecting means for establishing ink connection between said first ink container and said second ink container, wherein said ink communicating means is not externally exposed; detecting means for detecting mounting of said ink container to said ink jet recording apparatus; and control means for controlling recording operation of said ink jet recording apparatus in accordance with an output of said detecting means.

Thus, the ink container or the recording head can be replaced without introduction of the air.

In addition, when the ink container is not mounted, the recording operation of the ink jet recording apparatus is prevented from being carried out, and therefore, the ink supply failure during the recording operation can be avoided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
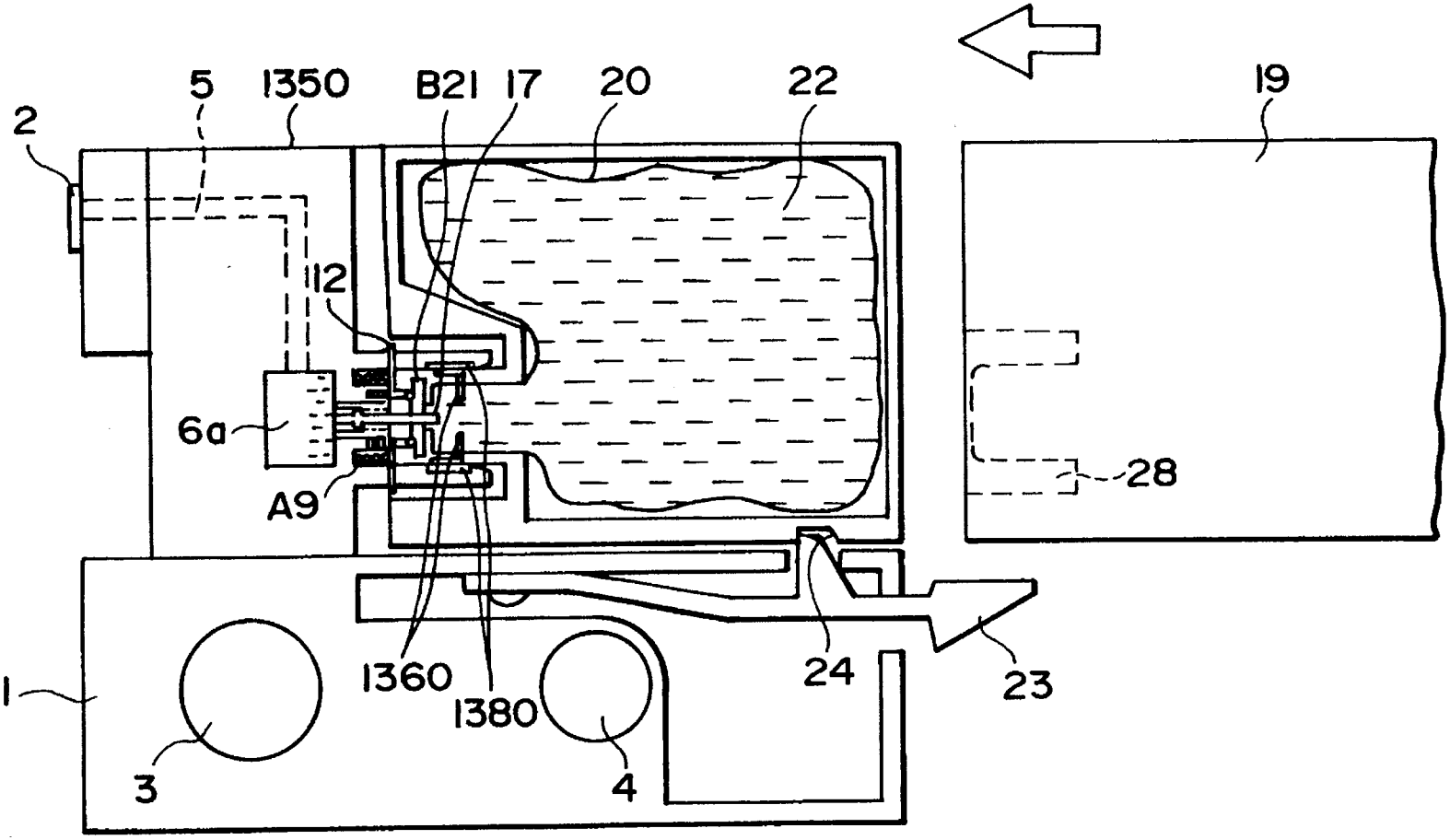
FIG. 1 is a sectional view of a recording head and an ink container according to an embodiment of the present invention.
Figure 2:
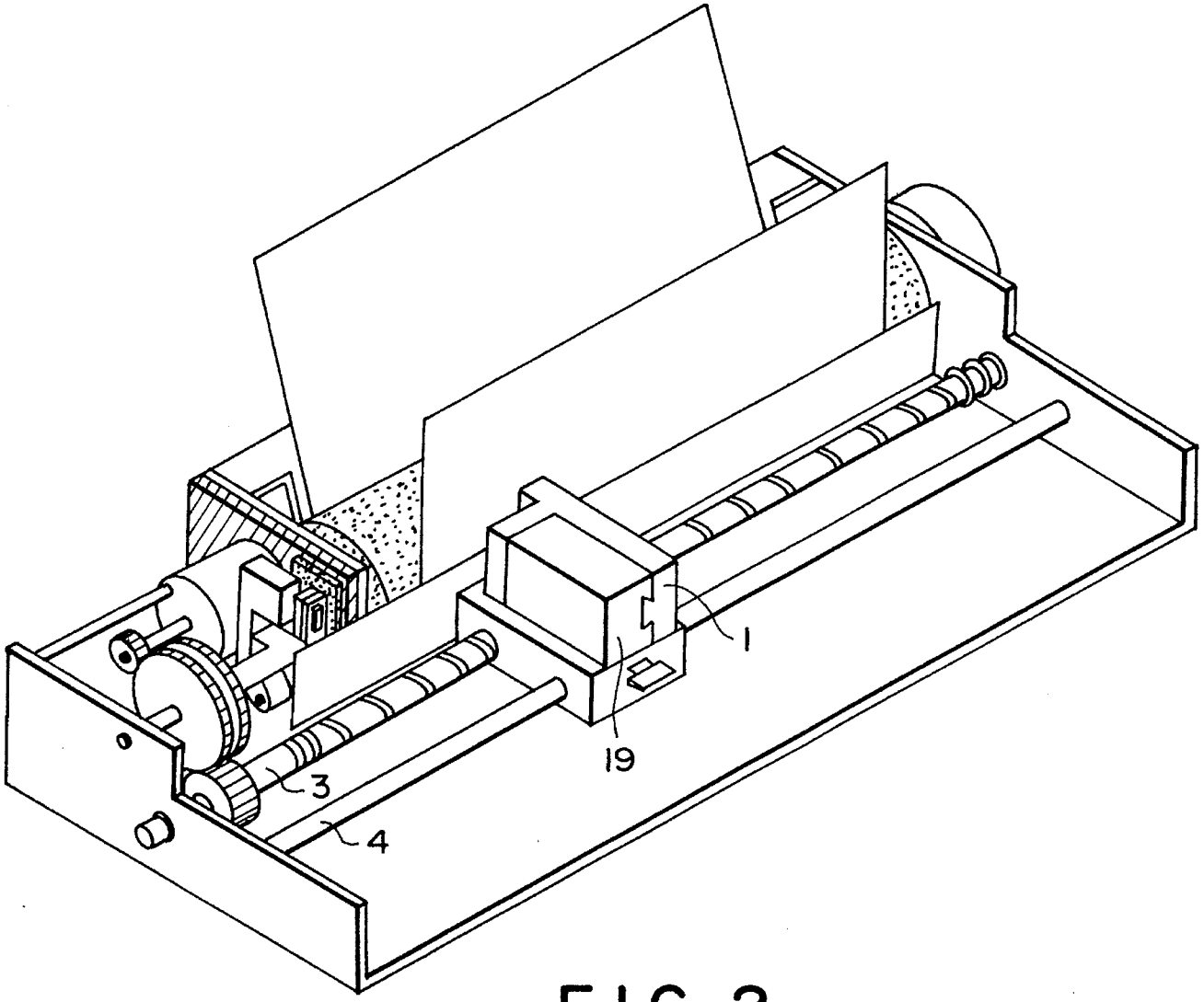
FIG. 2 is a perspective view of an entire printer usable with an ink container according to the embodiment of the present invention.
Figure 3:
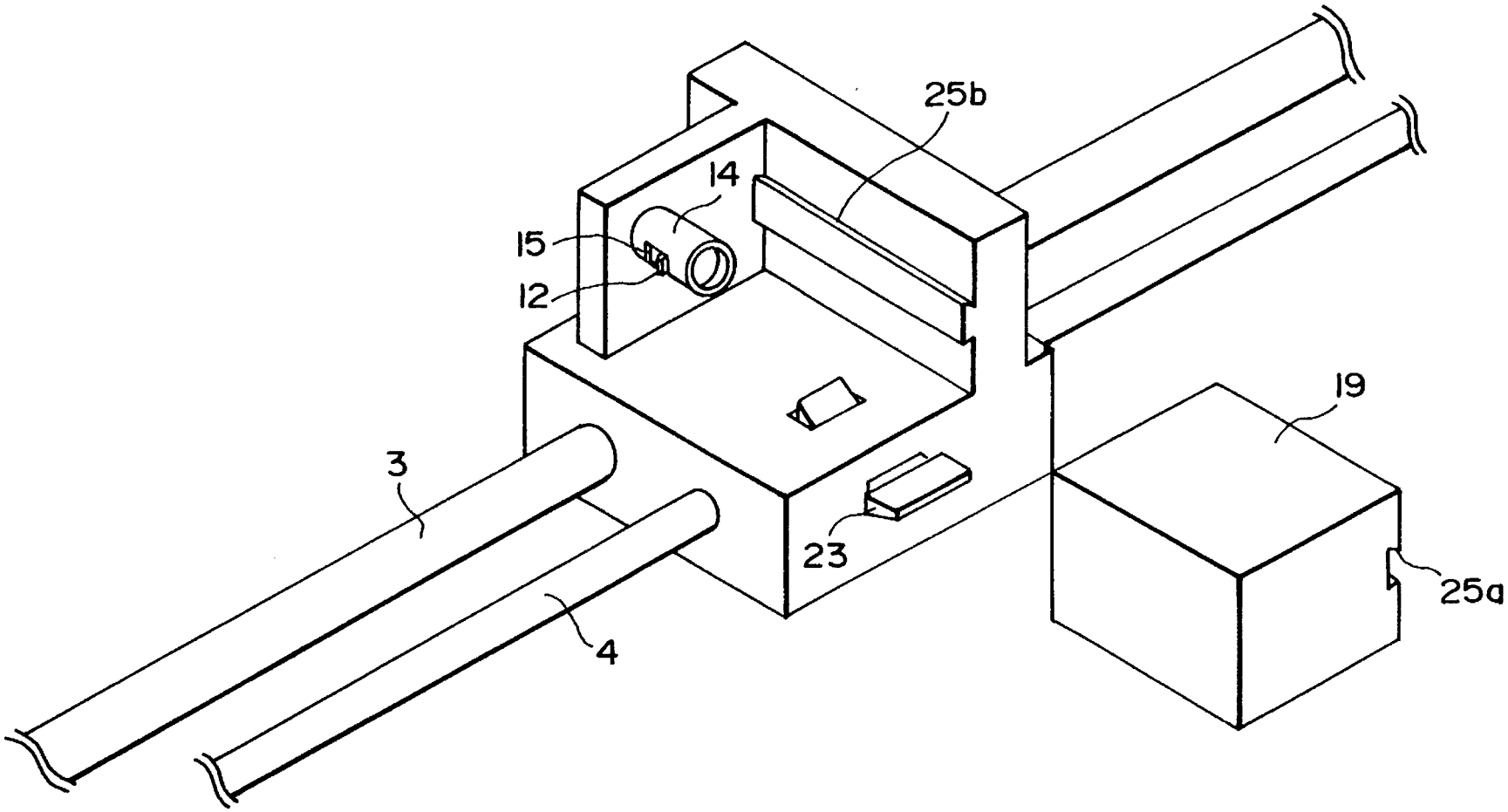
FIG. 3 is a perspective view of a carriage of the printer usable with the ink container, according to the embodiment of the present invention.
Figure 4:
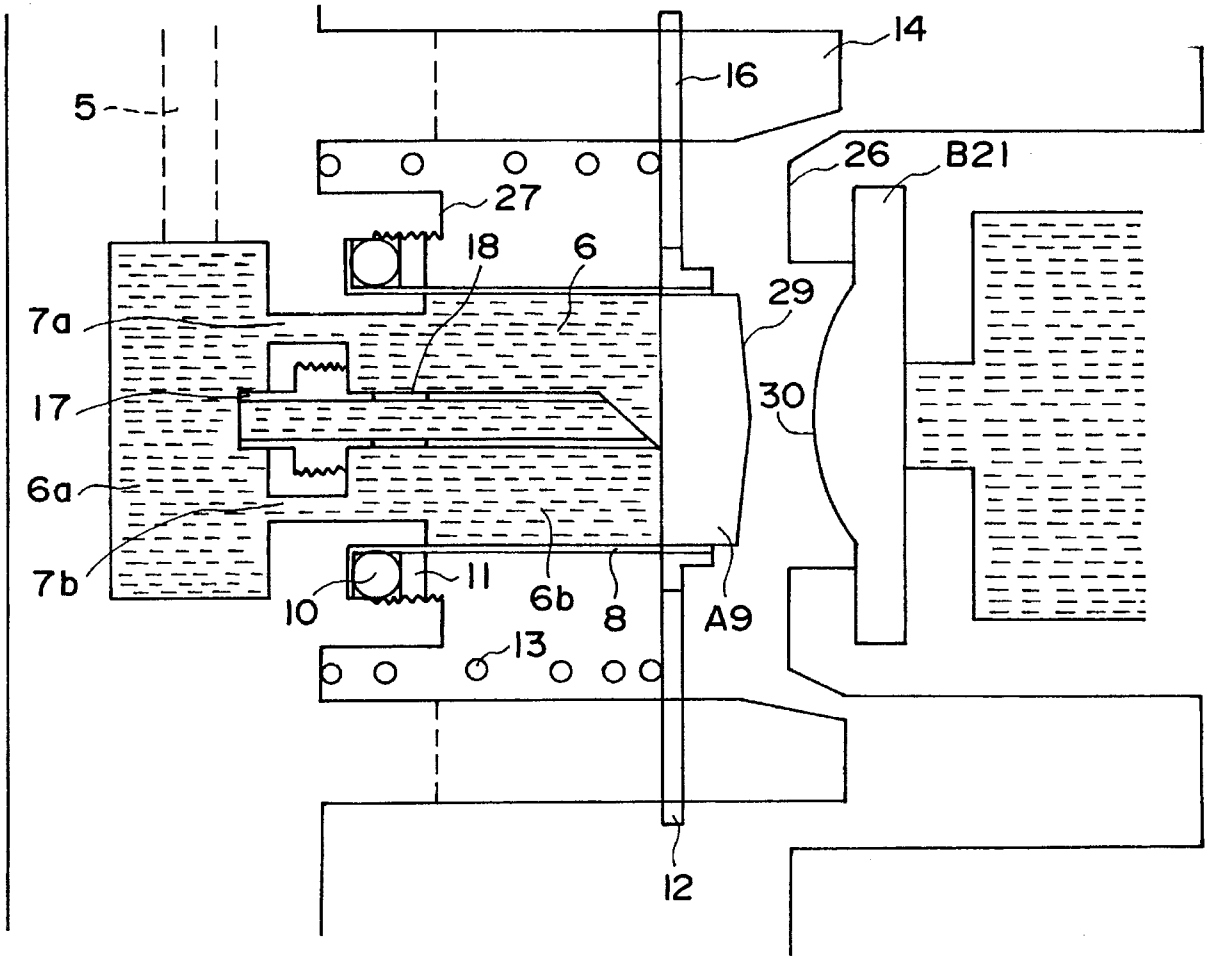
FIG. 4 is a partial sectional view illustrating detail of the joint portion between the recording head and the ink container.
Figure 5:
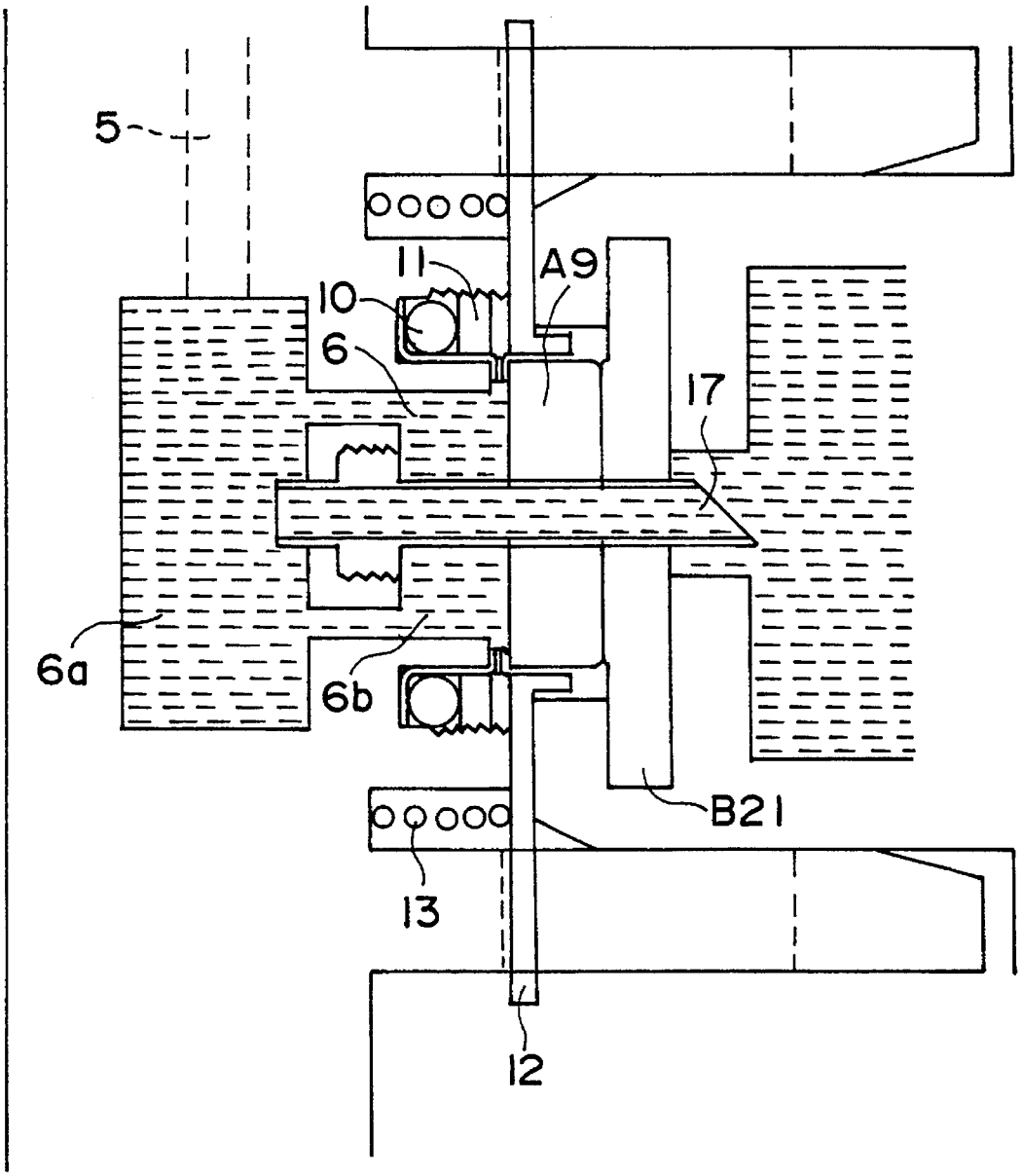
FIG. 5 is a detailed sectional view of connected recording head and the ink container.

Referring to FIGS. 1–5, there is shown an ink container for an ink jet recording apparatus, according to an embodiment of the present invention. FIG. 1 is a sectional view illustrating the feature of the invention. FIG. 2 is a perspective view of an entirety of the printer using the ink container according to the embodiment of the present invention. FIG. 3 is a perspective view of a carriage of the printer used with the ink container according to the embodiment of the present invention. FIG. 4 is a sectional view immediately before the ink container is mounted. FIG. 5 is a sectional view in which the ink container is mounted.

In FIGS. 1 and 2, to an ink jet head carriage 1, an ink jet recording head 2 is mounted. The ink jet head carriage 1 is movable in engagement with a carriage moving shaft 3 and a carriage guide shaft 4 of the main assembly of the printer. The ink jet head carriage 1 comprises an ink supplying pipe 5 for supplying the ink to the ink jet head 2 from a subordinate container **6*a*, as shown in FIGS. 1 and 4. The subordinate container (sub-container) 6*a* communicates with an ink accumulating portion 6*b* by passages 7*a* and 7*b*, which all constitutes a first ink container 6**.

In this embodiment, the first ink container 6 has a volume capacity of approximately 1 cc. The volume is selected because it is optimum from the standpoint of sufficiently reducing the size of the ink jet head carriage 1 and that it can contain sufficient amount of ink even when the ink container is not mounted to the passage extending to the ink jet head 2. However, the volume of the first ink container 6 may be properly selected depending on the specifications of the main assembly of the printer, and therefore, the volume is not limiting.

The ink containing portion **6*b* comprises an ink cover 8 made of flexible material such as rubber and an ink cap A9 made of flexible or deformable elastic material such as rubber. The ink cover 8 is fixed by the ink jet head carriage 1, an 0 ring 10 and a fixing member 11. The ink cap A9 is fixed on a movable stay 12. The stay 12 is contacts a surface of a cut-away portion 15 of a cylinder 14 formed on an ink jet head carriage 1, by a spring 13. An ink connecting tube 17 is provided at a position enclosed by the ink containing portion 6b and the sub-container 6a of the ink jet head carriage 1, that is, in the first ink container 6. The ink connecting tube 17 is in the form of a hollow cylinder, and the end thereof adjacent the ink cap A9 is cut obliquely as in an injection cannula for easy piercing the ink cap A9**.

Adjacent the base portion of the ink connecting tube 17 and adjacent the ink containing portion 6b, there are formed plural holes 18 to permit smooth flow of the ink.

When the ink container is not connected to the ink jet head, the ink connecting tube 17 is entirely enclosed in the first ink container 6 and is covered with the ink. Therefore, the ink connecting tube 17 is prevented from contacting the air. For this reason, the ink jet recording head 2 is protected from air introduction thereto. Additionally, the viscosity increase of the ink in the ink connecting tube 17 and the solidification thereof are prevented. Furthermore, the leakage of the ink to the outside can be avoided.

The joining of the ink container to the ink jet recording head will be described.

The ink jet head carriage 1 is provided in the main assembly of the printer. In this embodiment of the present invention, the operator mounts the ink container in the form of a replaceable cartridge on the ink jet head carriage 1.

In this Specification, the ink container of the replaceable cartridge will be called a second ink container 19.

The second ink container 19 is comprised of a plastic material or the like, and contains an ink bladder 20 containing the ink, an ink cap B21 made of flexible elastic material such as rubber to seal the ink bladder and the ink 22. The second ink container 19 comprises an engaging portion 24 engageable with a stopper 23 for fixing the second ink container 19 when it is mounted, a joint portion 28 engageable with a cylinder 14 formed as an engaging portion on an ink jet head carriage, and a guiding portion for guiding the entirety of the second ink container 19 relative to the ink jet head carriage 1, including an ink jet head carriage 1 side guide 25b and a second ink container 19 side guide 25a.

In this embodiment, the quantity of the ink contained in the second ink container 19 is approximately 20 cc. However, the volume capacity may be properly determined depending on the shape of the second ink container and shape and/or size of the ink jet head carriage 1, and therefore, the value of the ink volume capacity is not limiting.

The operator pushes the second ink container 19 along the guiding portions 25a and 25b. In the process of the pushing, joint portion 28 is inserted into the cylinder portion 14, and a top surface 26 of the joint portion 28 of the second ink container abuts the stay 12. Then, the operator feels the spring force of the spring 13, and further pushes the second ink container, by which the central portions of the ink cap A9 and the ink cap B21 are pressed together. In order to assure the press-contact between the ink cap A9 and the ink cap B21, these caps are formed into outwardly convex shapes, as indicated by reference numerals 29 and 30, respectively. The second ink container 19 is further pushed, and then, the stay 12 is pushed, so that the ink connecting tube 17 pierces the ink cap A9. At this time, the ink cover 8 slackens to follow the stay 12.

By further pushing, the ink connecting tube 17 pierces the ink cap B21. At this time, the central portions of the ink caps A9 and B21 are press-contacted to each other, and therefore, no air is introduced into the ink connecting tube. Finally, the second ink container 19 abuts projections 27 of the ink jet head carriage 1, and substantially simultaneously, the stopper 23 and the locking portion 24 are engaged, so that the second ink container 19 is fixed.

In this manner, the first ink container 6 and the second ink container 19 are connected properly to permit character or image recording using the large capacity second ink container 19, without the necessity for the air venting pumping action or the like at the time of connecting operation.

When the second ink container 19 is used up, the operator lowers the stopper 23 to release the second ink container 19 from the carriage. Then, the ink connecting tube 17 moves back relative to the ink cap B21 by the force of spring 13, and returns to the inside of the first ink container filled with the ink. Simultaneously, the second ink container 19 is pushed out by the spring 13 to a position for easy dismounting off the ink jet head carriage 1. Then, the operator is permitted to easily take the second ink container 19 out.

Embodiment 2

In the foregoing embodiment, the ink connecting tube 17 is at the fixed side, and the force applied to the second ink container 19 by the operator is used in which the ink cap A9 and the ink cap B21 are movable. The ink connecting tube 17 may be provided on the movable side. Such an embodiment will be described in detail.

Figure 6:
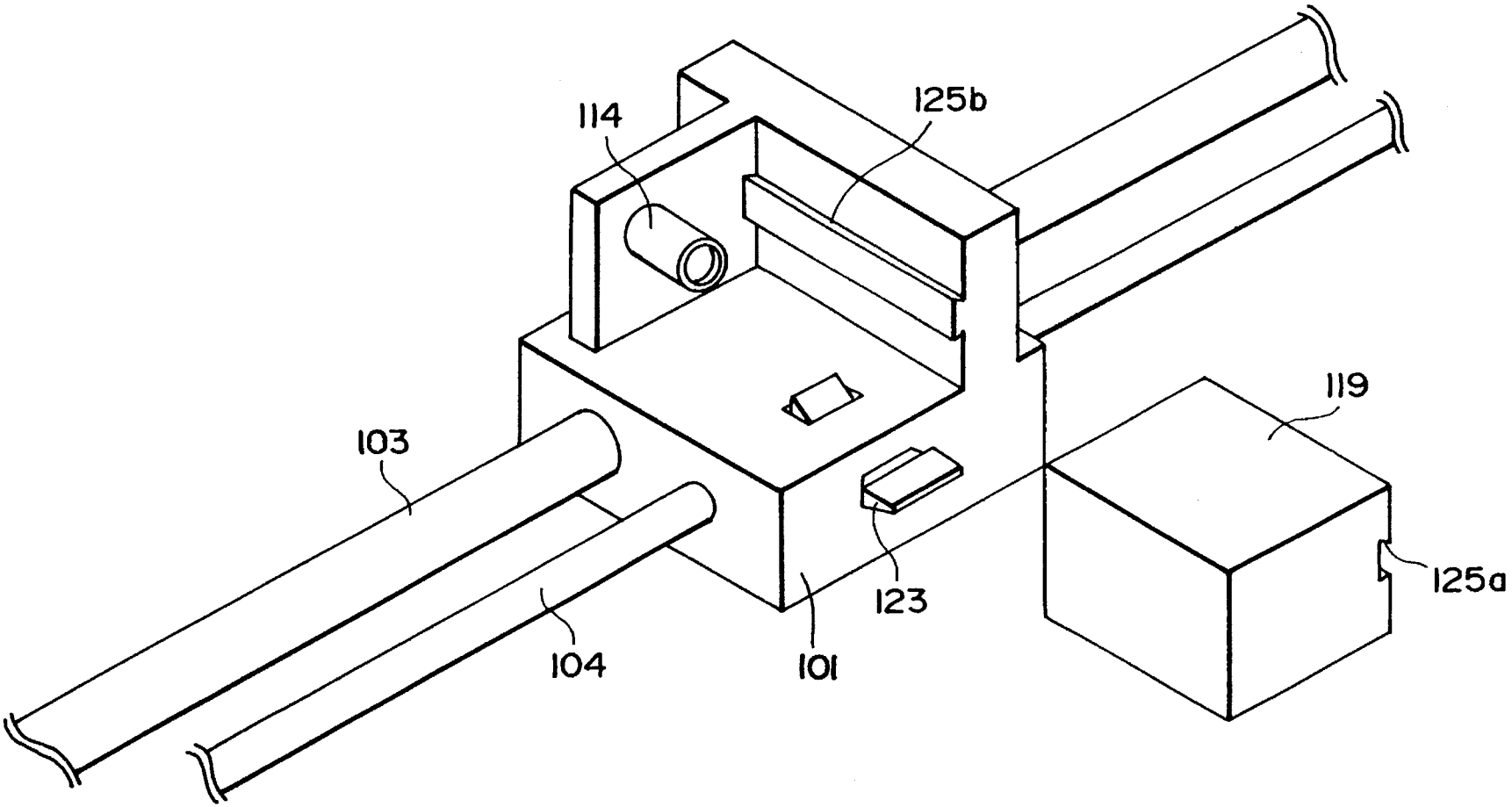
FIG. 6 is a perspective view of a carriage of a printer usable with an ink container according to another embodiment of the present invention.
Figure 7:
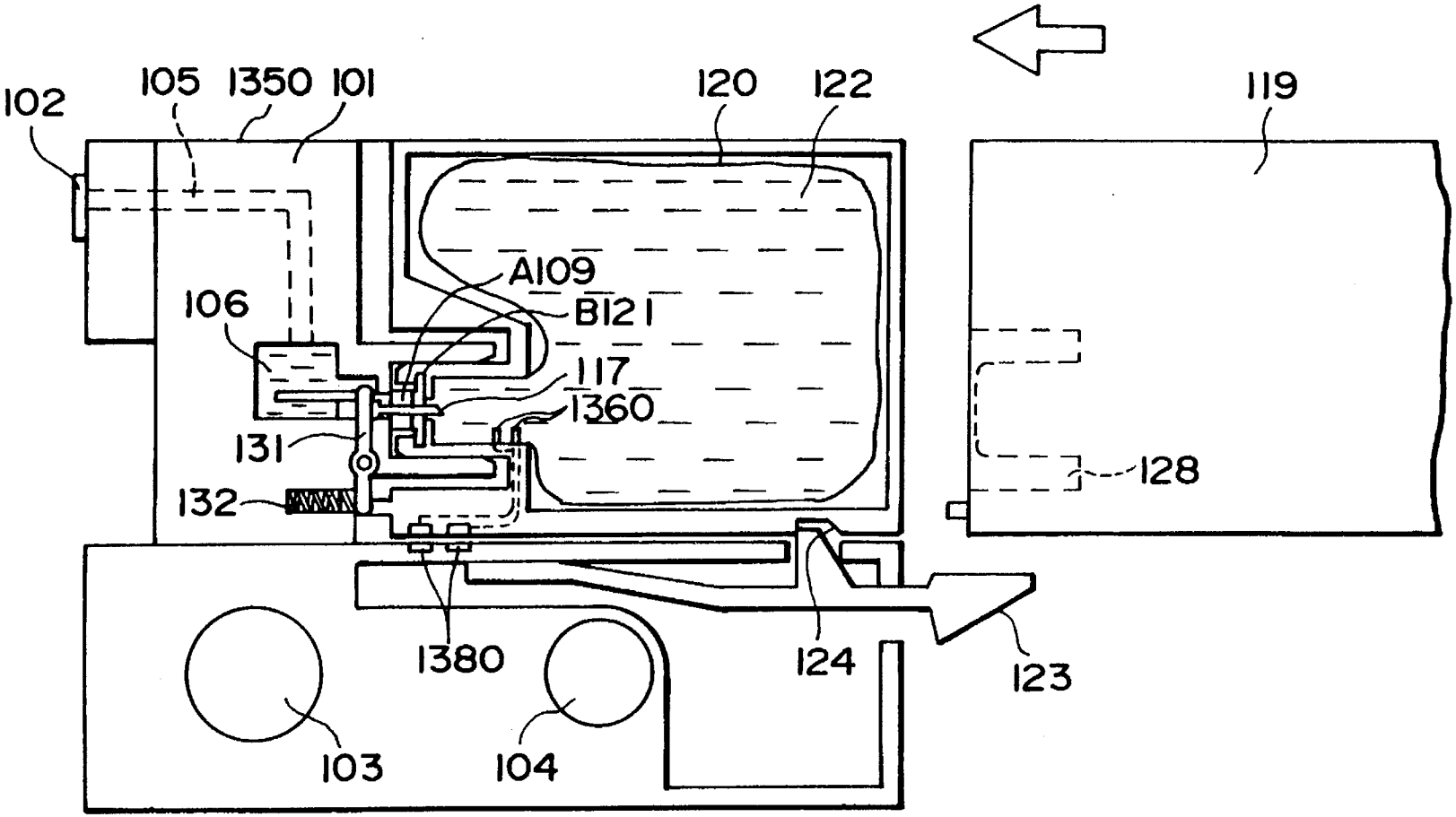
FIG. 7 is a sectional view illustrating the joint portion between the recording head and the ink container, according to the embodiment of the present invention.

Referring to FIG. 6, there is shown a carriage of a printer having an ink container according to a second embodiment of the present invention. FIG. 7 is a sectional view showing features of the second embodiment in detail.

Figure 8:
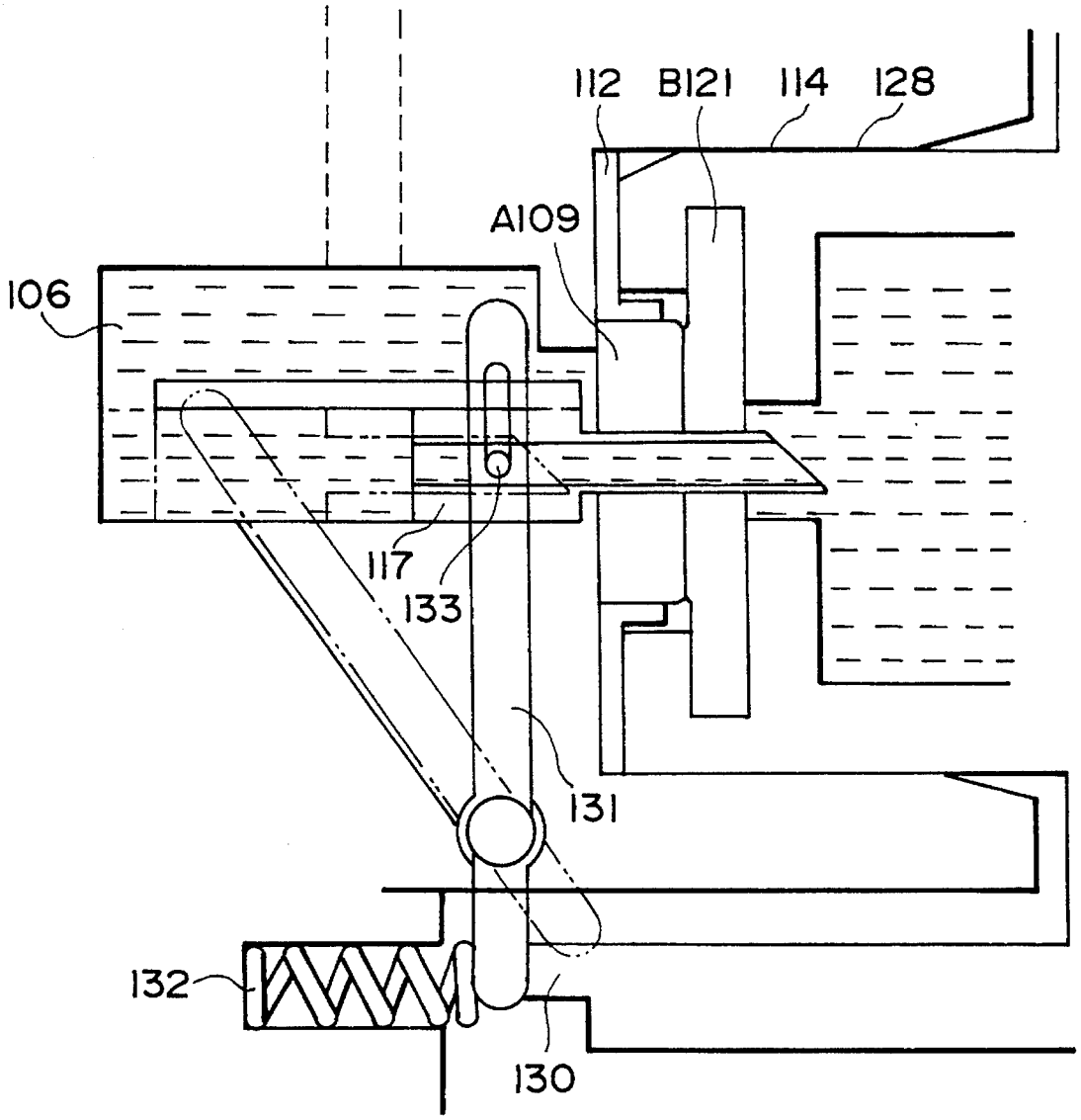
FIG. 8 is a detailed sectional view illustrating the recording head and the ink container jointed together, according to the embodiment of the present invention.

FIG. 8 is a detailed sectional view in which the ink container according to the second embodiment is mounted on the carriage.

An ink jet recording head 102 is fixed on the ink jet head carriage 101, which moves in engagement with a carriage driving shaft 103 and a carriage guiding shaft 104 of a main assembly of the printer. The ink jet head carriage 101 comprises an ink supply pipe 105 for supplying the ink to the ink jet recording head 102 and a first ink container 106. The first ink container 106 in this embodiment has a volume capacity of approximately 1 cc. The volume capacity is determined from the standpoint that the size of the ink jet head carriage 1 is made sufficiently small, and it can contain a sufficient amount of the ink even when the ink container is mounted for the ink jet head 102. However, the volume capacity of the first ink container 106 may be changed depending on the specifications of the main assembly of the printer, and therefore, the value of the capacity is not limiting.

The ink container 106 is sealed by an ink cap A109 made of flexible or deformable elastic material such as rubber. The ink cover A109 is fixed on a stay 112. The stay 112 is fixed on the ink jet head carriage 101.

An ink connecting tube 117 is provided in the first ink container 106 of the ink jet head carriage 101. The ink connecting tube 117 is in the form of a hollow cylinder, and an end thereof adjacent the ink cap A109 is cut inclined as in an injection cannula to permit easy piercing of the ink cap A109.

When the ink container is not connected, the entirety of the ink connecting tube 117 is contained in the first ink container 106 and is enclosed with the ink. Therefore, the ink connecting tube 117 is prevented from contact with the air, and therefore, there is no liability of the air introduction into the ink jet head 102. Similarly, the increase of the viscosity of the ink in the ink connecting tube 117 or the solidification thereof, can be avoided. Furthermore, the ink leakage to the outside can be avoided.

Then, the description will be made as the connecting portion of the ink container. The ink jet head carriage 101 is provided in the main assembly of the printer. In this embodiment, the operator mounts an ink container in the form of a replaceable cartridge on the ink jet head carriage 101 to effect printing of characters and images. In this embodiment, the ink container of the replaceable cartridge is called as second ink container 119.

The second ink container 119 comprises a housing made of plastic resin material or the like, which contains an ink bladder 120 containing the ink, an ink sealing cap B121 made of flexible elastic material such as rubber, and the ink 122.

The second ink container 119 includes an engaging portion 124 engageable with a stopper 123 for fixing the second ink container 119 when it is mounted, and a joint portion 128 for engagement with a cylinder 114 formed as a joint portion on the ink jet head carriage 101. Guiding portions for guiding the entirety of the second ink container 119 relative to the ink jet head carriage 101 are formed on the ink jet head carriage 101 and the second ink container 119, as indicated by references 125*b* and 125*a*, respectively.

In this embodiment, the ink capacity of the second ink container 119 is approximately 20 cc, but the capacity may be changed depending on the configuration of the second ink container 119, the configuration and the size of the ink jet head carriage 101. Therefore, this value is not limiting.

The operator pushes the ink container 119 along the guides 125*a* and 125*b*. In the process of the pushing, the joint portion 128 enters the cylinder 114.

On the other hand, the second ink container 119 is provided with a projection 130, and it abuts a driving lever 131 for moving the ink connecting tube 117. The driving lever 131 is urged by a spring 132, and is rotatably supported on the ink jet head carriage 1. An end of the driving lever 131 is engaged with the ink connecting tube 117 to permit movement of the ink connecting tube 117.

The projection 130 of the second ink container 119 further pushes the driving lever 131, the ink connecting tube 117 is moved by the driving lever 131 to pierce the ink cap A109, and substantially simultaneously therewith, the central portions of the ink cap A109 and an ink cap B121 are press-contacted to each other. So as to assure the press-contact at the central portions thereof between them, the central portions of the ink caps A109 and B121 have convex shapes opposed to each other.

With further pressing, the ink connecting tube 117 pierces through the ink cap B121. At this time, the central portions of the ink cap A109 and the ink cap B121 are press-contacted to each other, and therefore, no air is introduced into the ink connecting tube 117. Finally, the second ink container abuts the stay 112 of the ink jet head carriage 1, and substantially simultaneously, the engagement is established between the stopper 121 and the locking portion 124, so that the second ink container 119 is fixed on the carriage.

In this manner, the second ink container 119 is properly connected with the first ink container 106, so that the recording of characters and images are possible with use of the ink in the large capacity second ink container, without the necessity for the air venting pumping action or the like at the time of the connecting operation.

When the second ink container 119 is used up, the operator lowers the stopper 123 to release the second ink container 119 from the carriage. When it is released, the ink connecting tube 117 moves back relative to the ink cap B121 by the force of spring 132, and returns to the inside of the first container 106 filled with the ink. Simultaneously, the second ink container 119 is pushed out by the spring 132 and moves to an easy dismounting position on the ink jet head carriage 101. Thus, the operator can easily take the second ink container 119 out of the carriage.

The apparatus of the first or second embodiment is provided with an element for detecting presence and/or absence of the ink container mounted on the recording head or mounted on the carriage. The detecting element is effective to additionally detect the property of the ink container.

Referring back to FIG. 1, a pair of detecting elements 1380 are is mounted on side surfaces of a head holder 1350 to detect presence or absence of the ink container 19. One of the elements is a positive electrode, and the other is a negative electrode. They are electrically connected to respectively contact on a board by unshown leads. An end of each detecting element 1380 extends along a side surface of the head holder 1350. On the other hand, a pair of detection pins 1360 detects the amount of the ink in the ink containing chamber 20 of the ink container 19, An end of each of the detecting pins 1360 is provided along a side surface of the ink container, and the other end projects into the ink containing chamber 20. When the ends of both of the pins are in the ink, they are electrically connected through the ink. When the ink container 19 is mounted on the head holder 1350, the detecting pins 1360 are contacted to the respective detecting elements 1380. If the inside ends of the two detecting pins 1360 are in the ink, that is, if the amount of the ink is sufficient, the detecting pins 1360 are electrically connected through the ink. The state of a detecting circuit which will be described hereinafter is changed. On the basis of the change of the circuit, a discriminating circuit of the main assembly of the recording apparatus detects the presence of the ink in the ink container, and a signal indicative of such is supplied to a control circuit.

Thus, when the ink container containing therein a amount or more of ink is mounted on the recording head, the permitting signal can be transmitted to the main assembly when it is mounted on the main assembly.

Figure 9:
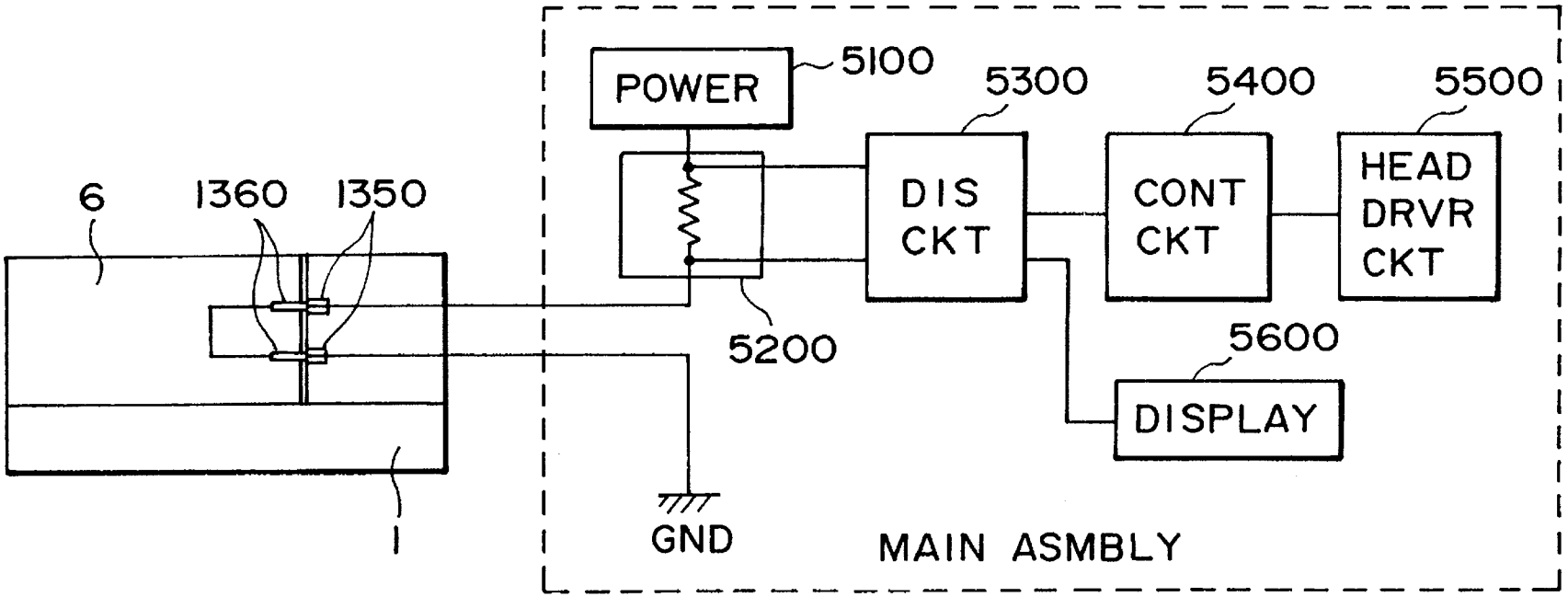
FIG. 9 is a block diagram of a system for detecting the ink container.

FIG. 9 is a block diagram of a ink amount detecting circuit for detecting the ink container and for detecting the amount of the remaining ink, using the detecting contacts 1380 and detecting pins 1360.

A current detecting circuit 5200 detects the current depending on connection or disconnection between the detecting contact 1380 and the detecting pin 1360 and depending on the ink amount, and the result of the detection is transmitted to the discriminating circuit 5300 which discriminates the presence or absence of the ink container and discriminates whether a sufficient amount of ink remains.

The signal indicative of the results of the discrimination is supplied to a control circuit 5400. When the mounting of the ink container 19 is discriminated, and the sufficient amount of ink is discriminated, the carriage and the recording head are driven by the recording head driving circuit 5550 and the like (the driving circuit for the carriage is not shown) so as to perform the normal recording operation. If the discriminating circuit 5300 discriminates the absence of the ink, the recording operation is disabled by the control circuit 5400.

The control circuit 5400 actuates a display device 5600 to display the results of the discriminating circuit 5300.

In this embodiment, the two detecting pins 1380 are used to detect the absence or presence of the ink. It is an alternative that a value indicative of the nature of the ink may be detected by the two detecting pins 1380 to detect the remaining amount of the ink.

In these embodiments, the current detecting circuit 5200 and the discriminating circuit 5300 are provided in the main assembly of the recording apparatus, but they may be provided in the recording head cartridge.

Figure 10:
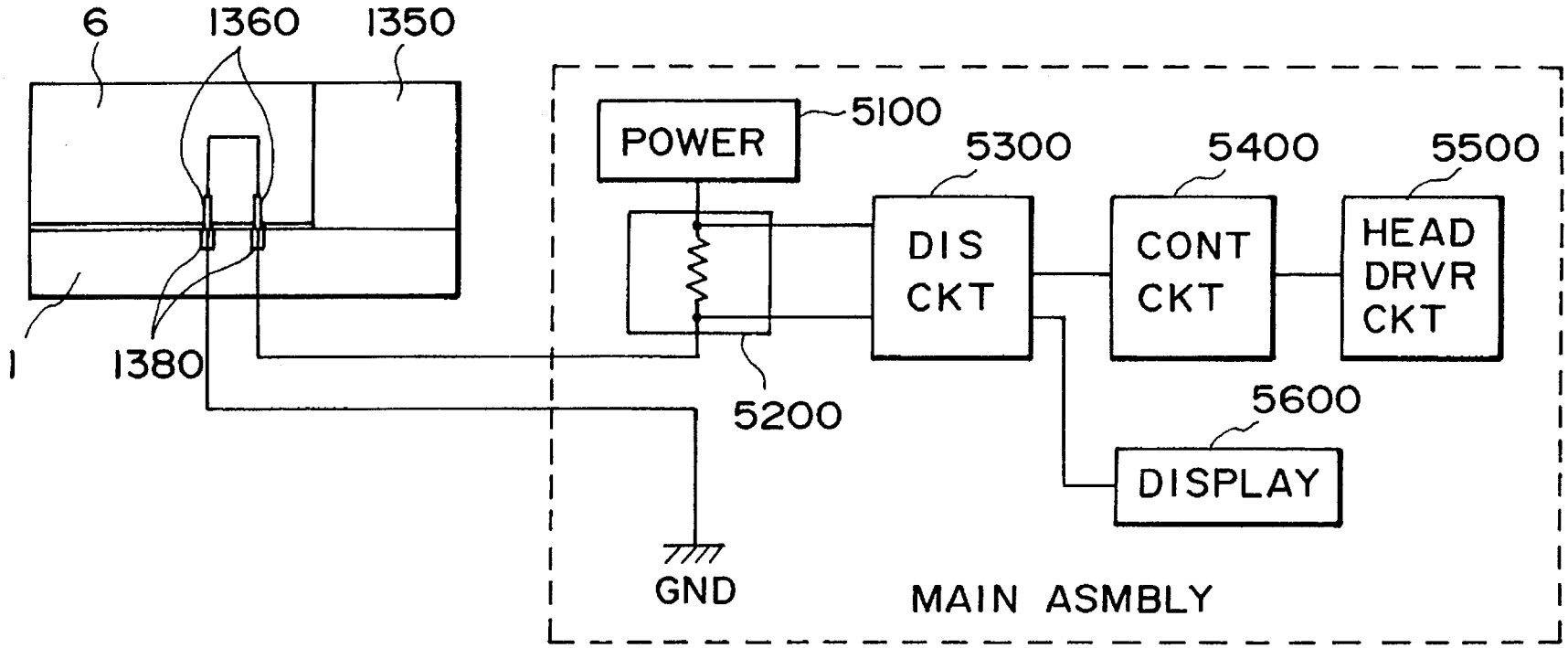
FIG. 10 is a block diagram of a system for detecting the ink container, according to a further embodiment of the present invention.
Figure 11:
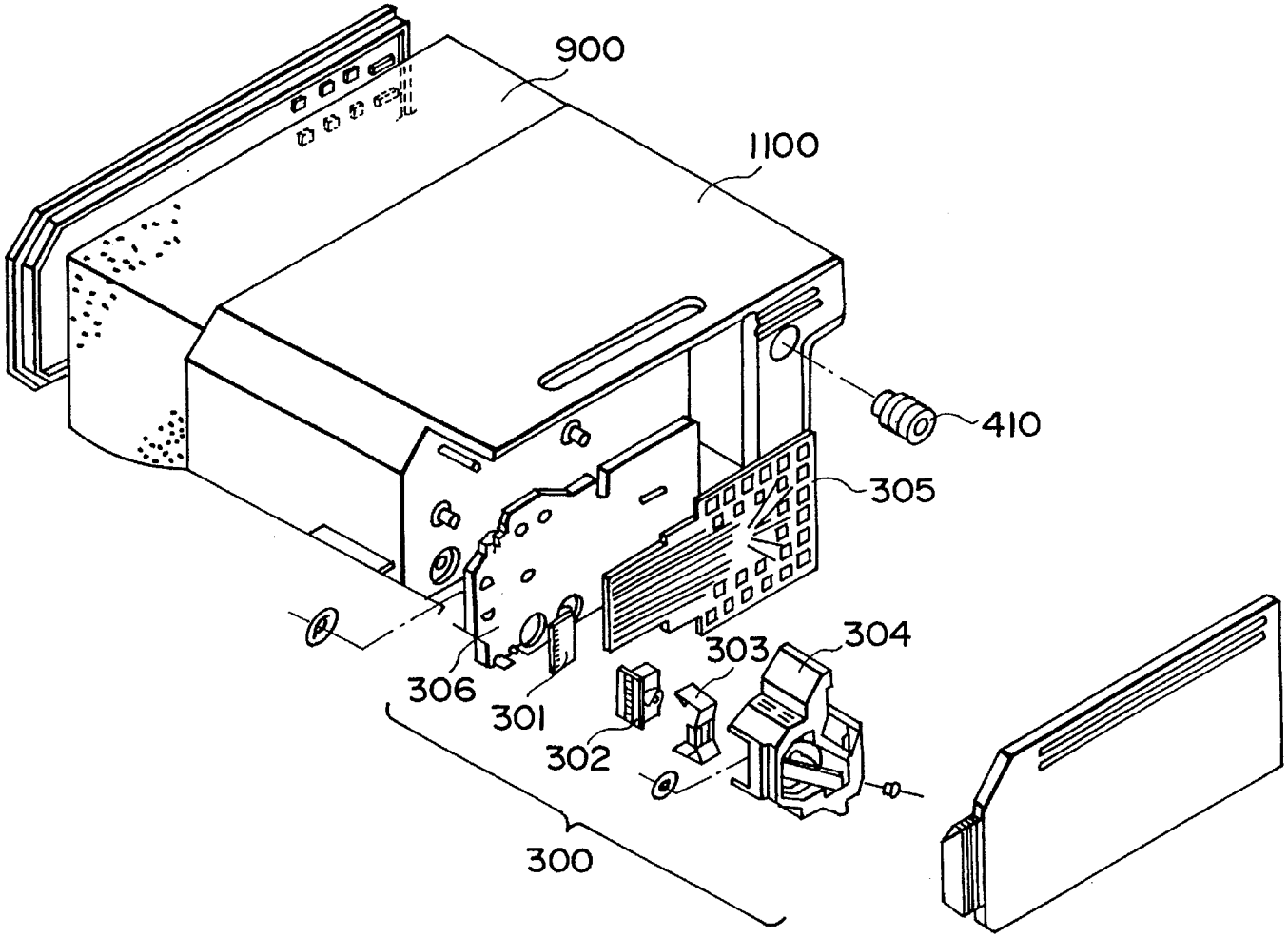
FIG. 11 is an exploded view of an ink jet cartridge containing an ink absorbing material.
Figure 12:
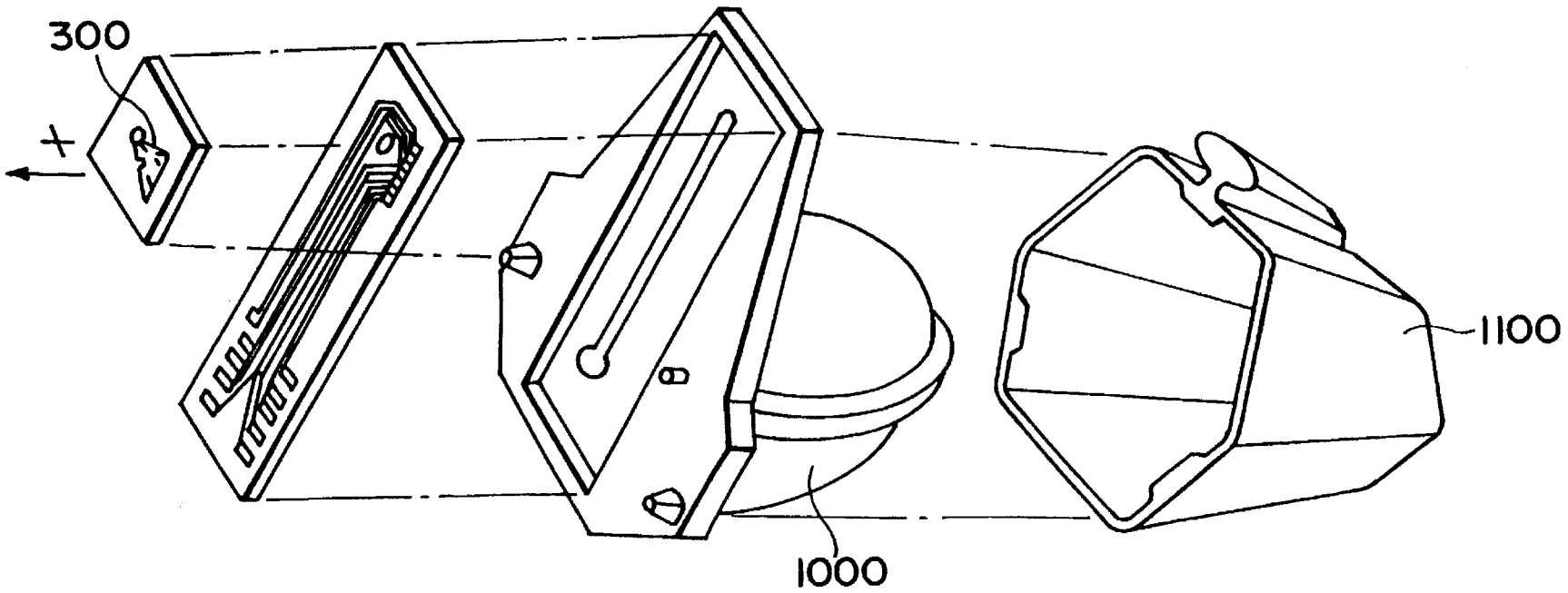
FIG. 12 PRIOR ART
FIG. 12 is an exploded view of an ink jet cartridge having rubber bladder as an ink container.

FIGS. 7 and 10 show another embodiment, in which detecting contacts 1360 for detecting presence or absence of the ink container are provided in the carriage 161. By the contacts, the presence or absence of the ink container and/or the ink, is detected when the head cartridge is mounted on the carriage. Similarly to FIGS. 1 and 9, the amount of the ink can be detected on the basis of the electric connection.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 38461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to a plurality of ink materials having different recording color or densities The present invention is effectively applicable to an apparatus having at least one of a monochromatic mode for recording mainly with black, a multi-color mode for recording with different color ink materials and/or a full-color mode for recording with a mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatuses of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced opposing the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the ink container can be mounted without introduction of the external air into the ink passage from the ink container to the ink jet recording head. Therefore, the pumping mechanism is not required for discharging the air introduced at the time of connection of the ink container to the apparatus or to the recording head. Therefore, the running cost is reduced by saving the wasteful ink discharged by the air discharging pumping operation. The structure of the main assembly of the printer may be simplified and can be reduced in the size. In addition, the cost thereof may be lowered. Since the connecting tube is not exposed, and therefore, the safety is further assured. Simultaneously, the ink is prevented from externally leaking through the connecting tube. Furthermore, the increase in the viscosity of the ink and the resultant clogging of the connecting tube, can be avoided.

In another aspect of the present invention, the recording operation of the ink jet recording apparatus is disables when the ink container is not mounted, and therefore, the shortage of the ink during the recording operation can be avoided.

Even if the recording operation is instructed erroneously with empty ink container, for example, the recording operation is not carried out, and therefore, the introduction of the air into the recording head or the ink leakage from the recording head, can be effectively prevented.

While the invention has been described with reference to the structures disclosed herein, it is not confined to the details set forth and this application is intended to cover such modifications or changes as may come within the purposes of the improvements or the scope of the following claims.

What is claimed is:

1. An ink jet apparatus comprising:

a recording head portion including a recording head with ink ejection outlets for effecting recording and a hermetically sealed first ink container in fluid communication with said recording head, said first ink container being at least partly constituted by a first elastic member;

a second ink container for containing ink to be supplied to said first ink container, said second ink container being at least partly constituted by a second elastic member;

an ink connecting member for establishing fluid communication between said first and second ink containers to supply ink to said first ink container from said second ink container, wherein said ink connecting member is entirely contained in said first ink container before being placed in fluid communication with said second ink container;

communicating means for permitting said ink connecting member to be placed in fluid communication with said second ink container through said first and second elastic members, wherein said communicating means includes urging means for urging said first elastic member in a direction preventing fluid communication with said second ink container; and a carriage for carrying said recording head portion and said second ink container.

2. An apparatus according to claim 1, wherein said ink connecting member is fixed in said first ink container.

3. An ink jet apparatus comprising:

a recording head portion including a recording head with ink ejection outlets for effecting recording and a hermetically sealed first ink container in fluid communication with said recording head, said first ink container being at least partly constituted by a first elastic member;

a second ink container for containing ink to be supplied to said first ink container, said second ink container being at least partly constituted by a second elastic member;

an ink connecting member for establishing fluid communication between said first and second ink containers to supply ink to said first ink container from said second ink container, wherein said ink connecting member is movable in said first ink container and said recording head portion includes means for moving said ink connecting member;

communicating means for permitting said ink connecting member to be placed in fluid communication with said second ink container through said first and second elastic members, wherein said ink connecting member is entirely contained in said first ink container before being placed in fluid communication with said second ink container; and a carriage for carrying said recording head portion and said second ink container.

4. An apparatus according to claim 3, further comprising:

an electrode pin in said second ink container for detecting a remaining amount of the ink therein;

a detector for detecting both whether or not said second ink container is mounted on the carriage and how much ink remains; and an electrode circuit for receiving a signal from said electrode pin.

5. An ink jet cartridge comprising:

a recording head portion including a recording head with ink ejection outlets for effecting recording and a hermetically sealed first ink container in fluid communication with said recording head, said first ink container being at least partly constituted by a first elastic member;

a second ink container for containing ink to be supplied to said first ink container, said second ink container being at least partly constituted by a second elastic member;

an ink connecting member for establishing fluid communication between said first and second ink containers to supply ink to said first ink container from said second ink container, wherein said ink connecting member is entirely contained in said first ink container before being placed in fluid communication with said second ink container; and communicating means for permitting said ink connecting member to be placed in fluid communication with said second ink container through said first and second elastic members, wherein said communicating means includes urging means for urging said first elastic member in a direction preventing fluid communication with said second ink container.

6. An ink jet cartridge according to claim 5, wherein said ink connecting member is fixed in said first ink container.

7. An ink jet cartridge comprising:

a recording head portion including a recording head with ink ejection outlets for effecting recording and a hermetically sealed first ink container in fluid communication with said recording head, said first ink container being at least partly constituted by a first elastic member;

a second ink container for containing ink to be supplied to said first ink container, said second ink container being at least partly constituted by a second elastic member;

an ink connecting member for establishing fluid communication between said first and second ink containers to supply ink to said first ink container from said second ink container, wherein said ink connecting member is movable in said first ink container and said recording head portion includes means for moving said ink connecting member; and communicating means for permitting said ink connecting member to be placed in fluid communication with said second ink container through said first and second elastic members, wherein said ink connecting member is entirely contained in said first ink container before being placed in fluid communication with said second ink container.

8. An ink jet cartridge according to claim 7, further comprising an electrode pin in said second ink container for detecting a remaining amount of ink therein.

* * * * *

UNITED STATES PATENT AND TRADEMARK OFFICE

CERTIFICATE OF CORRECTION

PATENT NO. : 5,500,664

DATED : March 19, 1996

INVENTOR(S) : ETSUROU SUZUKI ET AL.

It is certified that error appears in the above-identified patent and that said Letters Patent is hereby corrected as shown below:

COLUMN 1

Line 23, "shows an example" should read --show examples--.
Line 24, "(see also)" should read --(see also--.
Line 25, "in" should be deleted.
Line 26, "4,771,295)" should read --4,771,295))--.
Line 41, "No. 8857/1984" should read --No. 98857/1984--.
Line 50, "and" should be deleted.
Line 51, "therefore" should be deleted.

COLUMN 4

Line 65, "is contacts a" should read --contacts a top--.

COLUMN 7

Line 51, "through" should be deleted.

COLUMN 8

Line 39, "a amount" should read --a predetermined amount--.
Line 50, "and" should be deleted.

UNITED STATES PATENT AND TRADEMARK OFFICE

CERTIFICATE OF CORRECTION

PATENT NO. : 5,500,664

DATED : March 19, 1996

INVENTOR(S) : ETSUROU SUZUKI ET AL.

It is certified that error appears in the above-identified patent and that said Letters Patent is hereby corrected as shown below:

COLUMN 9

Line 12, "carriage 161." should read --carriage 101.--

COLUMN 10

Line 24, "densities" should read --densities.--.

COLUMN 11

Line 16, "disables" should read --disabled--.

Signed and Sealed this

First Day of October, 1996

Bruce Lehman

*Attest:*

BRUCE LEHMAN

*Attesting Officer*

*Commissioner of Patents and Trademarks*